US005314025A

United States Patent [19]

Priestly

[11] Patent Number: 5,314,025

[45] Date of Patent: May 24, 1994

[54] FLUID PUMPING APPARATUS AND METHOD OF PUMPING FLUID

[75] Inventor: Ronald A. Priestly, Longview, Tex.

[73] Assignee: Fluid Master, Inc., Kilgore, Tex.

[21] Appl. No.: 975,686

[22] Filed: Nov. 12, 1992

[51] Int. Cl.[5] ..... E21B 43/00; F04B 7/04; F04B 21/02

[52] U.S. Cl. ..... 166/369; 166/105; 417/415; 417/417

[58] Field of Search ..... 166/105, 106, 108, 369; 417/56, 60, 415, 418, 417, DIG. 2

[56] References Cited

U.S. PATENT DOCUMENTS 3,364,864 1/1968 Ghoerghe ..... 417/418 X
4,538,970 9/1985 Rabson ..... 417/417
4,548,552 11/1985 Holm ..... 417/417
5,058,667 10/1991 Ramsower ..... 166/105 X

*Primary Examiner*—David J. Bagnell

*Attorney, Agent, or Firm*—Ronald B. Sefrna

[57] ABSTRACT

A fluid pumping apparatus for producing fluid from a well through production tubing comprises an elongate hollow body to be disposed in a well bore and at least partially submerged in fluid to be produced from the well, the body including fluid inlet valve at its lower end for flow of fluid into the body, a plunger assembly disposed in the interior of the body for reciprocating movement relative thereto, sealing means cooperating with the plunger assembly to divide the body into isolated lower and upper chambers and to isolate the body from the production tubing, and fluid flow control valves operationally synchronized so that fluid is forced up the production tubing upon downstroke of the reciprocating plunger assembly in the body of the pumping apparatus. A method of pumping fluid utilizing the apparatus of the invention to produce fluid on the downstroke of the plunger assembly is also provided.

18 Claims, 4 Drawing Sheets

FLUID PUMPING APPARATUS AND METHOD OF PUMPING FLUID

FIELD OF THE INVENTION

The present invention generally relates to fluid pumping apparatus, and in at least some of its embodiments more specifically relates to reciprocating pump apparatus to be placed at a production zone in a well casing for pumping fluid to the surface upon each downstroke of the pumping apparatus.

BACKGROUND OF THE INVENTION

The use of longitudinally reciprocating pumps to raise fluid from a well to the surface is of long standing and generally well known in the prior art. It is typical for a well from which fluid, such as water or crude oil, is to produced to be completed with a cylindrical casing extending from the surface downward to a fluid-containing zone from which fluid is to be drawn. The casing defines the well bore and is typically perforated at the production zone to allow fluid to flow into the casing. Pumps known in the prior art typically include an elongate string of production tubing extending down the casing, with a pump body at the lower end of the tubing, typically activated by an elongate string of rods extending through the interior of the tubing. A reciprocating pumping action is utilized to lift fluid from the pump body up the production tubing upon each upstroke of the apparatus. While effective in the sense of moving fluid up the production tubing to the surface, there are significant disadvantages and inefficiencies associated with pumps previously known in the art.

In many instances, the fluid to be produced is located a substantial distance below the surface, so that the weight of the activation rods, typically referred to as "sucker rods," and pump is also substantial. Since prior art pumps move fluid toward the surface by lifting the fluid on the upstroke of the pump apparatus, it is necessary to lift not only the weight of the column of fluid, but also the weight of the sucker rods and reciprocating pump components on each production stroke. With prior art pump designs no fluid production occurs on the downstroke, which serves only to lower the apparatus for another upstroke. The lifting of the weight of the reciprocating production apparatus on each production stroke is inefficient and directly wasteful of energy, since energy associated with downward movement of the pumping apparatus on each downstroke is not utilized for any productive purpose.

There remains a need for a pumping apparatus for production of fluid from a well that efficiently utilizes the energy available for fluid production to the surface. Accordingly, it is among the objects of the invention to provide a pumping apparatus without the inefficiencies and disadvantages of the prior art. It is also among the objects of the invention to provide a pumping apparatus that utilizes the energy added to the pumping apparatus during upstroke to produce fluid on the downstroke. It is further among the objects of the invention to utilize the weight of the sucker rods and reciprocating pump apparatus and its movement in response to gravity as a source of pumping energy. It is additionally among the objects of the invention to provide a self-adjusting sealing means between reciprocating pump components and stationary pump components to automatically compensate for wear.

SUMMARY OF THE INVENTION

The apparatus of the invention is useful for the production of any fluid that must be pumped from a well, including production of crude oil from oil wells and production of water from water wells. A typical well production installation with which the apparatus may be used generally includes an elongate cased well bore extending from the surface to a geological strata or zone at which the desired fluid is present, an elongate string of hollow production tubing extending from the surface down the interior of the well casing to the fluid zone, a pump apparatus connected to the lower end of the production tubing, an elongate string of pump activating rods, or sucker rods, extending through the interior of the production tubing, and a pump driver at the surface to raise and lower the string of sucker rods and induce up and down reciprocating movement of pump apparatus components. In the prior art, fluid is lifted to the surface by successive upstrokes of the pump apparatus induced by the pump driver and transmitted by the string of sucker rods. The present invention provides a highly efficient pumping apparatus for moving fluid up a well from an underground production zone to the surface, utilizing not only energy provided by the pump driver, but also energy available from the action of gravitational acceleration upon pump components and sucker rods associated with the pumping apparatus.

The pumping apparatus of the invention includes an elongate hollow cylindrical body smaller in cross-sectional dimension than the casing of the well in which the pump apparatus is to be used. The lower end of the body is provided with a fluid inlet valve, such as a ball valve, that allows fluid to flow into the interior of the apparatus through the valve while preventing flow of fluid from the interior of the body. The upper end of the body includes perforations in the side wall, forming passages for flow of fluid from the interior of the body to the well casing. The body is connected at its upper end to production tubing extending to the surface, with the interior of the body in communication with the interior of the tubing.

The apparatus further includes a plunger assembly disposed within the interior of the body. The plunger assembly generally comprises a first cylindrical piston slightly smaller in diameter than the diameter of the body, and a second piston or shaft of substantially smaller diameter coaxially aligned with the first piston and extending outward from the upper end of the first piston. An elongate central aperture extends through both first and second pistons along their aligned longitudinal axes. The upper end of the second piston is connected to a string of sucker rods extending through the interior of the production tubing so that the plunger assembly can be moved up and down relative to the body by movement of the sucker rods. A fluid control valve is provided at the lower end of the first piston to allow fluid to flow from the interior of the body into the central aperture but prevent backflow of the fluid. Another fluid control valve is provided at the upper end of the second piston to allow fluid to flow from the central aperture into the production tubing, while preventing backflow from the tubing into the aperture. Sealing means are provided between the outer surface of the first piston and the wall of the body to form a fluid tight sliding seal and effectively divide the body into a lower chamber, below the sealing means, and an upper chamber. Additional sealing means is provided between the second piston and the transition between body and production tubing, to seal the upper chamber of the body from the tubing. The second piston performs the functions of transmitting reciprocal driving force to the first piston, conveying fluid to the production tubing, and assisting in sealing the upper end of the body from the interior of the production tubing.

The sealing means of the invention includes two groups of resilient packing material disposed between the respective piston and the pump body, with the two groups separated from each other to form an annular space that is filled with a lubricant material. Each group of packing material is maintained under compressive force by a tension spring, causing the resilient packing to expand laterally and maintain a secure seal between piston and body over an extended operational period. The packing material may be in any convenient form, such as discrete rings or coils, suitable for the intended use.

With the unique design of the pumping apparatus of the invention, production of fluid from the well is achieved by utilizing the force produced by the effect of gravity acting on the mass of the plunger assembly and the string of sucker rods, on the downstroke of the pump. Conventional reciprocating pumps produce fluid by using the upstroke of the pump to lift fluid up the production tubing. Consequently, the pump driver at the surface must provide sufficient power to not only lift the weight of the plunger and sucker rod string, but also to lift the weight of the column of fluid in the production tubing. With the pump of the invention no fluid is lifted on the upstroke, so the power requirements for the pump driver substantially reduced. Further, the power utilized to lift the plunger assembly and sucker rods through the upstroke is regained on the downstroke.

On the upstroke of the pumping apparatus of the invention, the fluid control valves of the plunger assembly are closed and a partial vacuum is produced in the lower chamber of the body, so that fluid flows from the well casing into the body through the inlet valve. When downstroke begins the inlet valve of the body closes and the control valves of the plunger assembly open. Downward movement of the first piston displaces the fluid in the lower chamber of the body through the lower plunger assembly control valve into the central aperture, through the central aperture to the upper end of the second piston, through the upper plunger assembly control valve, and up the production tubing to result in production of a volume of fluid at the surface equal to the displacement of fluid from the lower body chamber. As upstroke begins the control valve operation immediately reverses, preventing backflow of fluid through the apparatus, and allowing the sucker rod string and upper portion of the second piston above the second sealing means to move through the fluid in the production tubing without obstruction. The perforations in the upper chamber of the body allow pressure equalization between the upper chamber and the well casing as the plunger assembly moves up and down.

The structure and features of the invention will be described in more detail below, with reference to the accompanying drawing figures.

DETAILED DESCRIPTION OF THE PREFERRED EMBODIMENT

Figure 3:
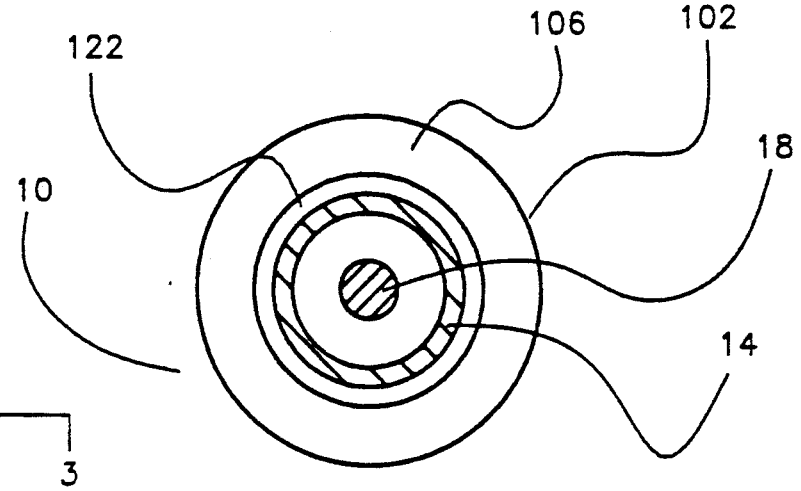
FIG. 3 is a top plan view of the preferred embodiment of the apparatus of the invention disposed in a well casing, along line 3—3 of FIG. 1.
Figure 1:
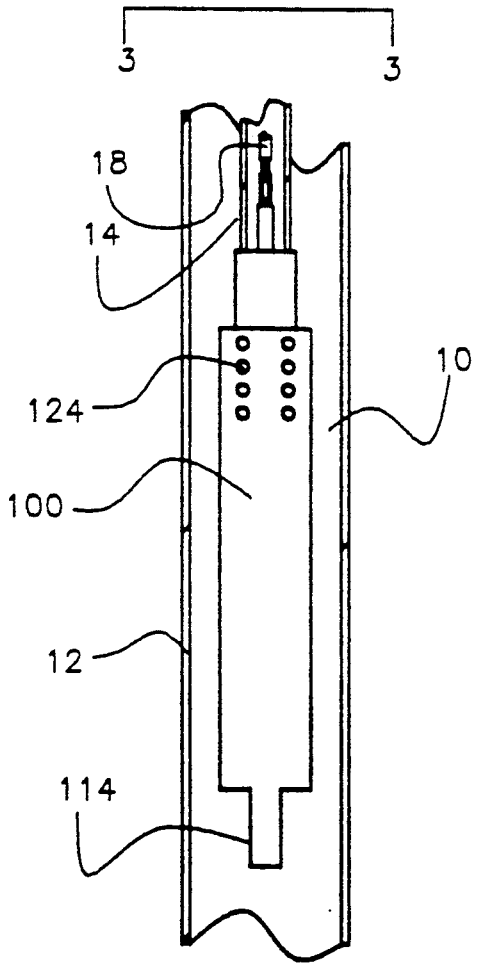
FIG. 1 is a side elevation view of the preferred embodiment of the apparatus of the invention disposed in a well casing.

With reference to the accompanying drawing figures, the pumping apparatus of the invention, generally designated by reference numeral 10, will be seen to include a body 100, a plunger assembly 200, a barrel sealing assembly 300, and a neck sealing assembly 400. Apparatus 10 is intended to be disposed below the surface of the ground in a well bore, typically completed with a casing 12, with the body connected to a string of hollow production tubing 14 and at least partially submerged in standing fluid to be produced from the well.

Body 100 comprises an elongate hollow cylindrical barrel having side wall 102, an annular bottom closure plate 104, and an annular top closure plate 106. The annulus of the bottom closure plate surrounds a fluid inlet aperture 108, and the annulus of the top closure plate surrounds aperture 110. Fluid inlet nipple 112, a hollow open ended nipple, is connected to bottom closure plate 104 around aperture 108 and extends outwardly from plate 104. In the preferred embodiment inlet nipple 112 functions as a valve body for an inlet valve 114 and includes annular valve seat 116 extending inward from the inner surface of nipple 112 around fluid passage 118. Ball 120 is disposed in the interior of nipple 112 between valve seat 116 and bottom closure 104, and is configured to close passage 118 when received against valve seat 116. Bottom closure plate 104 functions as a retainer for ball 120, and aperture 108 is preferably configured to allow the flow of fluid around ball 120 with ball 120 against bottom closure plate 104. Body 100 further includes hollow open ended neck 122 interconnected to top closure plate 106 around aperture 110 and extending upwardly therefrom. The upper end of neck 122 is adapted for connection to production tubing 14. The upper portion of side wall 102 is penetrated by a plurality of perforations 124.

Figure 6:
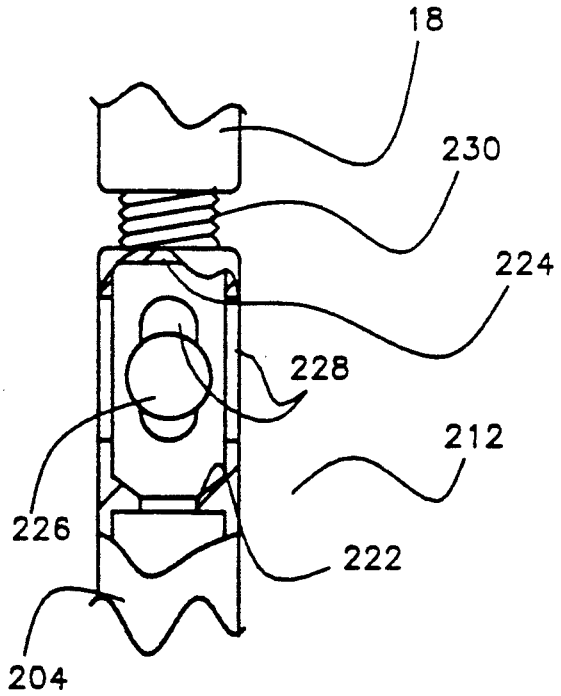
FIG. 6 is a partially sectioned side elevation detail view of the upper fluid flow control valve of the plunger assembly of the preferred embodiment of the apparatus of the invention.
Figure 2:
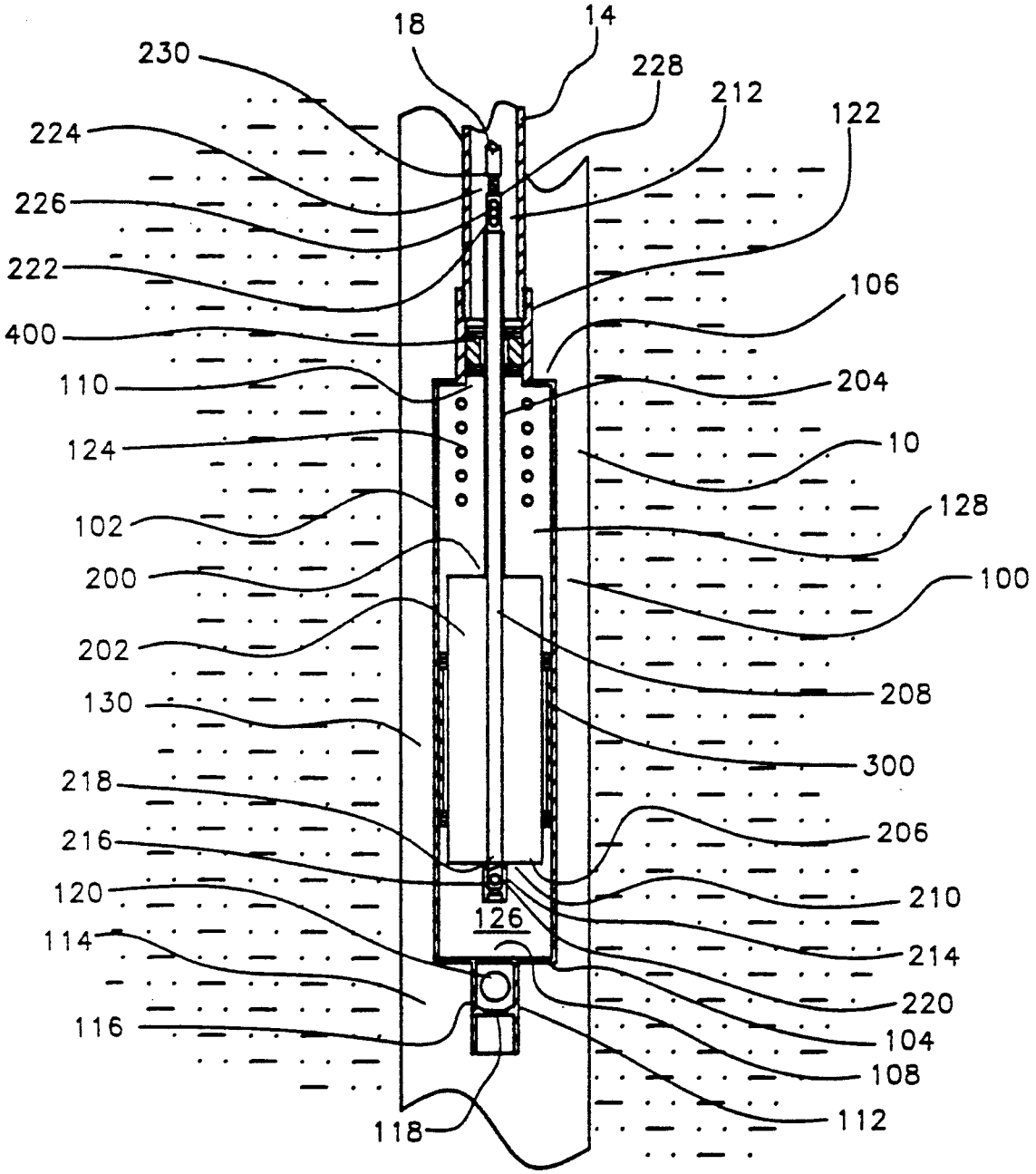
FIG. 2 is a longitudinally sectioned side elevation view of the preferred embodiment of the apparatus of the invention as depicted in FIG. 1.

Plunger assembly 200 generally comprises an elongate first piston 202, preferably cylindrical in configuration and slightly smaller in cross-sectional dimension than body 100, disposed in the interior of body 100, and an elongate second piston 204 coaxially aligned with and interconnected to the upper end of first piston 202. First piston 202 includes lower face 206. Pistons 202 and 204 are penetrated by continuous elongate fluid aperture 208 extending fully through both pistons in coaxial alignment therewith. Plunger assembly 200 also includes a lower fluid flow control valve 210 and an upper fluid flow control valve 212. Lower control valve 210 is similar in configuration to inlet valve 114 and includes valve body 214, formed as a hollow open ended nipple, interconnected to and extending outward from lower face 206 in coaxial alignment with fluid aperture 208, and having lower annular seat 216 and upper retainer 218 with ball 220 disposed between. Upper fluid flow control valve 212, illustrated in FIG. 6, is provided at the upper end of second piston 204, and similarly includes lower annular seat 222, upper retainer 224, and ball 226 disposed between. Upper valve 212 also includes fluid outlet slots 228 through which fluid may flow through the valve to the interior of production tubing 14. Connector stud 230 extends upwardly from the upper end of fluid flow control valve 212 for connection of plunger assembly 200 to a string of sucker rods 18. It is preferred that the cross-sectional dimension of second piston 204 be approximately equal to the cross-sectional dimension of sucker rods 18, so that no fluid is lifted by second piston 204 up the production tubing on upstroke of plunger assembly 200 and resistance to upward movement of second piston 204 through fluid in the production tubing is essentially eliminated.

Figure 4:
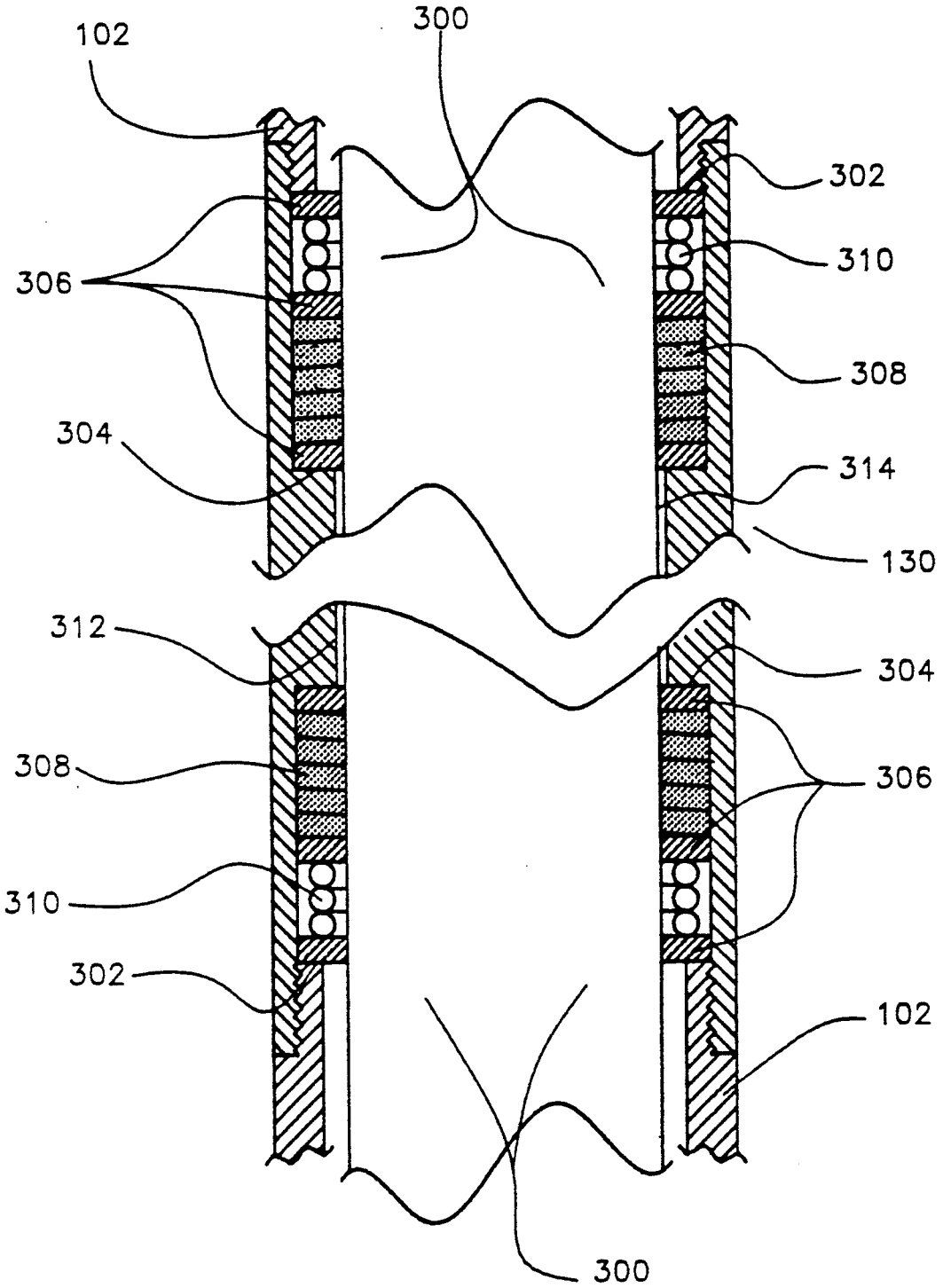
FIG. 4 is a sectioned side elevation detail view of the preferred embodiment of the sealing means of the invention.

Plunger assembly 200 is sealed against body 100 by barrel sealing assembly 300, disposed between the barrel of body 100 and first piston 202, and by neck sealing assembly 400, disposed between neck 122 of body 100 and second piston 204. First piston 202 and barrel sealing assembly 300 functionally divide the interior of body 100 into two chambers, a lower chamber 126 and an upper chamber 128. Sealing assemblies 300 and 400, which form fluid tight sliding seals, are essentially identical in structure, and the following description of sealing assembly 300 will be understood to apply to sealing assembly 400 and to components thereof unless otherwise specifically noted. Referring particularly to FIG. 4, it will be seen that in the preferred embodiment sealing assembly 300 is divided into identical upper and lower portions. In the following description omission of the modifier indicates that the discussion is equally applicable to upper and lower components.

Figure 5:
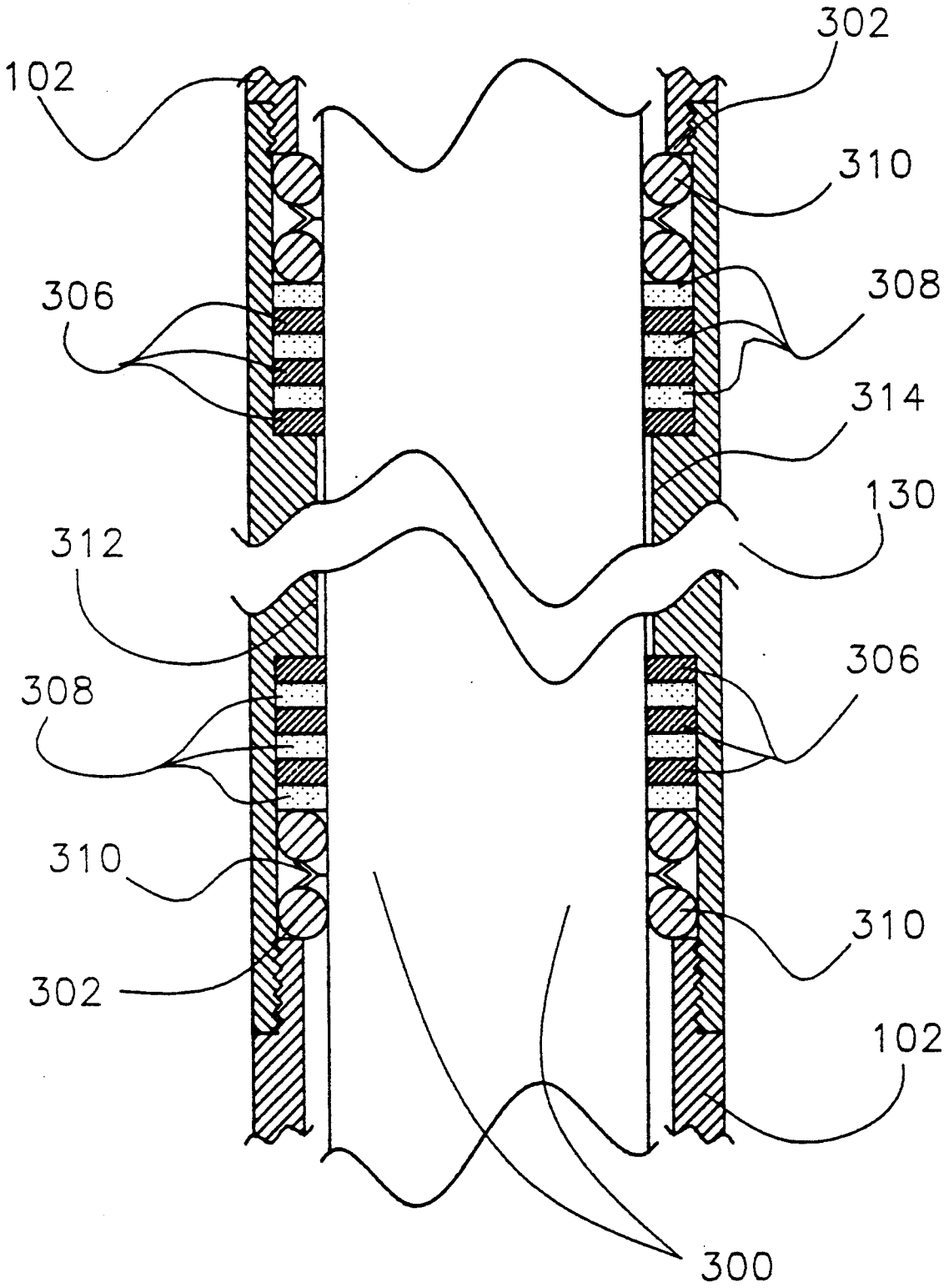
FIG. 5 is a sectioned side elevation detail view of an alternative embodiment of the sealing means of the invention.

As illustrated in FIG. 4, the barrel of body 100 is divided laterally into three segments, a lower chamber 126 between bottom closure 104 and the lower portion of first piston 202, an upper chamber 128 between top closure 106 and the upper portion of first piston 202, and stuffing box 130 associated with sealing assembly 300. As illustrated, the segments are preferably joined by threaded connections formed in side wall 102, and the thickness of wall 102 in stuffing box 130 is thinned in the area of the threaded connections to form outer retaining ledge 302 and inner retaining ledge 304. In the preferred embodiment a first retaining ring 306 is disposed against ledge 302, followed by a compression spring 310, a second retaining ring 306, resilient packing material 308, and a third retaining ring 306 disposed against ledge 304. It is preferred that retaining rings 306 be of brass and that packing material 308 be in the form of a coil of Kevlar TM material, though other materials may be used if desired. Compression spring 310 compensates for packing wear by maintaining a constant force acting to compress the packing material and force the packing material against the piston. Although it is preferred that a spring 310 be provided at each end of sealing means 300, spring 310 may be omitted from one end if desired. It is further preferred that compression spring 310 be a coil spring, though it will be understood that any suitable compression spring design may be used. In an alternative embodiment, illustrated in FIG. 5, the coil of packing material 308 is replaced by discrete rings of packing material 308, alternating with additional retaining rings 306, and the first and second retaining rings 306 and the coil spring embodiment of compression spring 310 are replaced by a compression spring 310 with integral retainer rings. Any combination of the preferred and alternative embodiments specifically disclosed may be used, or other packing and retaining arrangements suitable for the intended purpose may be used within the scope of the invention. The upper and lower portions of sealing means 300 are separated by an annular space 312 which is preferably filled with a lubricant 314. Lubricant 314 is retained by rings 306 and packing 308, and serves to reduce friction between pistons 202 and 204 and the respective sealing means for efficient operation and reduced component wear. Though lubricant 314 serves a useful function, it may be omitted without departing from the scope of the invention. Over a period of operation of the pumping apparatus the movement of plunger assembly 200 relative to body 100 against the packing rings of the sealing assemblies will cause wear of such packing rings and eventually failure of the sealing assemblies. In addition to the reduction in the rate of wear achieved by the use of lubricant 314, the compressive force imposed on the packing rings by springs 310 produces a lateral expansion of the rings against the respective piston surface, further extending the useful life of the sealing assembly components and reducing maintenance requirements.

Because it utilizes the force produced by the action of gravity on the combined mass of plunger assembly 200 and the string of sucker rods 18, pump apparatus 10 is highly efficient in operation. When prepared for use, pumping apparatus 10 will be disposed and conventionally supported in a well casing, with both production tubing and sucker rods connected to the apparatus and extending to the surface. A pump driver (not shown in the drawing figures) is used to produce reciprocal, up and down, movement of the sucker rods and thus of the plunger assembly of the apparatus of the invention. In preparation for pump operation the lower chamber 126 of apparatus 10 should be free of air or other gas to prevent "gas lock".

On the upstroke of the pumping action plunger assembly 200 of apparatus 10 is raised relative to body 100, increasing the volume of lower chamber 126 and decreasing the volume of upper chamber 128. On the upstroke lower and upper fluid flow control valves 210 and 212 are closed and fluid inlet valve 114 is open. As the volume of lower chamber 126 is decreased a partial vacuum is created, inducing the flow of fluid into lower chamber 126 from the well casing through fluid inlet valve 114. Upon completion of the upstroke lower chamber 126 is full of fluid to be produced from the well. As downstroke is initiated fluid flow control valves 210 and 212 open and inlet valve 114 closes. Through the downstroke the volume of lower chamber 126 is reduced and the volume of upper chamber 128 is increased. The downward movement of first piston 202 in lower chamber 126 increases pressure on the fluid in lower chamber 126, causing it to flow through lower fluid flow control valve into central aperture 208, through aperture 208 and upper fluid flow control valve, and into production tubing 14. Introduction of the volume of fluid displaced by first piston 202 into production tubing 14 immediately above apparatus 10 causes a simultaneous production of the same volume of fluid at the surface. Upper chamber 128 of the barrel of body 100 is isolated from both lower chamber 126 and production tubing 14, and perforations 124 allow the exchange of liquid and/or gas between the interior of upper chamber 128 and the well bore to equalize pressure during upstroke and downstroke.

Upon completion of downstroke and initiation of upstroke, fluid flow control valves 210 and 212 close and inlet valve 114 opens, for repetition of the described sequence. It will be understood that during upstroke the pump driver is required to lift only the weight of the sucker rods and plunger assembly. No fluid is lifted during upstroke. In deep wells the weight of the column of fluid in the production tubing is substantial, and the work required to lift that column is also substantial. On downstroke of the apparatus of the invention, the potential energy stored by elevation of the sucker rods and plunger assembly is converted to kinetic energy and used to force fluid to the surface, utilizing the energy expended during upstroke less only frictional losses. By comparison, conventional pumping apparatus performs pumping "work" only on the upstroke and the downstroke serves only to "reset" the pumping apparatus for another production upstroke. The foregoing description of the preferred embodiment of the pumping apparatus of the invention and of the method of fluid production utilizing the apparatus of the invention is illustrative and not for purposes of limitation. The apparatus and method are susceptible to various modifications and alternative embodiments in addition to those described, without departing from the scope and spirit of the invention as claimed.

What is claimed is:

1. A fluid pumping apparatus for pumping fluid from a well to the surface through an elongate string of production tubing extending down the well bore from the surface, upon activation by a pump driver at the surface through a string of sucker rods extending through the production tubing, comprising a body having an elongate hollow barrel with a longitudinal axis, a lower end, an upper end, and a continuous side wall, said body also having a bottom closure closing said lower end of said barrel, a fluid inlet passageway through said bottom closure from the exterior of said barrel to the interior thereof, inlet valve means disposed in said fluid inlet passageway for the purpose of allowing fluid to flow from the exterior of said barrel to the interior thereof while preventing fluid from flowing from the interior of said barrel to the exterior thereof through said inlet valve means, a top closure closing said upper end of said barrel, said top closure having an aperture extending therethrough coaxially aligned with said longitudinal axis of said barrel, a hollow open ended neck interconnected to said top closure around said aperture therein and extending upwardly therefrom, and tubing connection means for connecting said body to the production tubing;

a plunger assembly, having a longitudinal axis, a lower end, and an upper end, disposed partially in the interior of said body, said plunger assembly including a first piston with a lower end and an upper end, disposed in said barrel in coaxial alignment therewith and in sliding relation therewith, said first piston having a lower face at said lower end thereof, a second piston, having a longitudinal axis, a lower end, and an upper end, being substantially smaller in cross-sectional dimension than said first piston, interconnected at its lower end to said upper end of said first piston in coaxial alignment and extending upwardly therefrom through said neck of said body, an elongate piston aperture extending through said first piston and through said second piston in coaxial alignment with said longitudinal axes thereof so as to form a fluid conduit through said plunger assembly, lower control valve means disposed in said fluid conduit near said lower end of said first piston for the purpose of allowing fluid to flow into said fluid conduit from the interior of said barrel through said lower control valve means while preventing fluid from flowing from said fluid conduit through said lower control valve means, and upper control valve means disposed in said fluid conduit near said upper end of said second piston for the purpose of allowing fluid to flow from said fluid conduit through said upper control valve means while preventing fluid from flowing into said fluid conduit through said upper control valve means;

first sealing means disposed between said first piston of said plunger assembly and said barrel of said body for the purpose of forming a fluid-tight sliding seal between said first piston and said barrel, dividing said barrel into a lower chamber below said first sealing means and an upper chamber above said first sealing means; and second sealing means disposed between said second piston of said plunger assembly and said neck of said body for the purpose of forming a fluid-tight sliding seal between said second piston and said neck, separating said upper chamber of said barrel below said second sealing means from the interior of the production tubing above said sealing means.

2. The fluid pumping apparatus of claim 1, wherein the cross-sectional area of said first piston at said lower face thereof is substantially greater than the cross-sectional area of said fluid conduit.

3. The fluid pumping apparatus of claim 1, wherein said body further includes pressure equalization means for the purpose of equalizing pressure between said upper chamber of said body and the well bore exterior to said body and exterior to the production tubing.

4. The fluid pumping apparatus of claim 3, wherein said pressure equalization means comprises one or more apertures penetrating said side wall of said barrel, said one or more apertures disposed between said first sealing means and said top closure of said body.

5. The fluid pumping apparatus of claim 3, wherein said plunger assembly further includes sucker rod connection means for the purpose of connecting said upper end of said second piston to a string of sucker rods extending through the production tubing to the surface.

6. The fluid pumping apparatus of claim 1, wherein the cross-sectional dimension of said second piston is approximately equal to the cross-sectional dimension of the sucker rods extending through the production tubing.

7. The fluid pumping apparatus of claim 1, wherein said inlet valve means comprises a hollow open ended inlet valve body forming said inlet passageway, said inlet valve body having a continuous side wall, a lower end, and an upper end, an annular inlet valve seat extending into the interior of said inlet valve body from said side wall around a central opening, an inlet valve ball retainer extending into the interior of said inlet valve body from said side wall and disposed between said inlet valve seat and said upper end of said inlet valve body, and an inlet valve ball disposed in said inlet valve body between said annular inlet valve seat and said inlet valve ball retainer, said inlet valve ball forming a fluid-tight seal when received against said inlet valve seat to prevent the flow of fluid around said inlet valve ball and through said inlet valve seat, and said inlet valve ball allowing the flow of fluid around said inlet valve ball and through said inlet valve body when removed from said inlet valve seat.

8. The fluid pumping apparatus of claim 1, wherein said lower control valve means comprises a hollow open ended lower control valve body coincident with said fluid conduit at said lower end of said first piston, said lower control valve body having a continuous side wall, a lower end, and an upper end, an annular lower control valve seat extending into the interior of said lower control valve body from said side wall around a central opening, a lower control valve ball retainer extending into the interior of said lower control valve body from said side wall and disposed between said lower control valve seat and said upper end of said lower control valve body, and a lower control valve ball disposed in said lower control valve body between said lower control valve seat and said lower control valve ball retainer, said lower control valve ball forming a fluid-tight seal when received against said lower control valve seat to prevent the flow of fluid from said fluid conduit around said lower control valve ball and through said lower control valve seat, and said lower control valve ball allowing the flow of fluid into said fluid conduit around said lower control valve ball and through said lower control valve body when removed from said lower control valve seat.

9. The fluid pumping apparatus of claim 1, wherein said upper control valve means comprises a hollow open ended upper control valve body coincident with said fluid conduit at said upper end of said second piston, said upper control valve body having a side wall, a lower end, and an upper end, an annular upper control valve seat extending into the interior of said upper control valve body from said side wall around a central opening, a upper control valve ball retainer extending into the interior of said upper control valve body from said side wall and disposed between said upper control valve seat and said upper end of said upper control valve body, and an upper control valve ball disposed in said upper control valve body between said upper control valve seat and said upper control valve ball retainer, said upper control valve ball forming a fluid-tight seal when received against said upper control valve seat to prevent the flow of fluid into said fluid conduit around said upper control valve ball and through said upper control valve seat, and said upper control valve ball allowing the flow of fluid from said fluid conduit around said upper control valve ball and through said upper control valve body when removed from said upper control valve seat.

10. The fluid pumping apparatus of claim 1, wherein each of said first sealing means and said second sealing means comprises a first seal assembly extending between said side wall of said barrel and said first piston and between said neck and said second piston, respectively, a second seal assembly separated from said first seal assembly with said second seal assembly extending between said side wall of said barrel and said first piston and between said neck and said second piston, respectively, forming a closed space between each of said first and second seal assemblies, and lubricant material disposed in said closed space.

11. The fluid pumping apparatus of claim 10, wherein each of said first seal assemblies comprises an outer retaining ring farthest from said closed space between said first and second seal assemblies, a compression spring with upper and lower ends disposed with its upper end against said outer retaining ring and with its lower end extending toward said closed space, a compression ring disposed against said lower end of said compression spring, resilient packing means extending from said compression ring toward said closed space and terminating against an inner retaining ring adjacent to said closed space, and wherein each of said second seal assemblies is a reverse repetition of each of said first seal assemblies mirrored across a plane lying between said first and second seal assemblies perpendicular to said longitudinal axis of said barrel.

12. The fluid pumping apparatus of claim 11 wherein said resilient packing means comprises a plurality of resilient packing rings.

13. The fluid pumping apparatus of claim 11 wherein said resilient packing means comprises a coil of resilient packing material.

14. A fluid pumping apparatus comprising an elongate body having a longitudinal axis, a hollow interior, a lower end and an upper end, and a continuous side wall, said body being closed at its lower end and open at its upper end;

a plunger assembly having a piston with a longitudinal axis, a lower face and an upper face, disposed in the interior of said body in coaxial substantially fluid-tight sliding relation therewith, said piston dividing said body into a lower chamber and an upper chamber, an elongate plunger shaft having a longitudinal axis, a lower end and an upper end, interconnected at its lower end to said upper face of said piston in coaxial alignment therewith, extending from said piston through said open upper end of said body in substantially fluid-tight sliding relation with said body at said upper end, and an elongate fluid aperture extending from said lower face of said piston, through said piston and through said plunger shaft to form a fluid passageway from said lower chamber of said body to the exterior of said body above said upper end thereof;

inlet valve means communicating between said lower chamber of the interior of said body and the exterior of said body for the purpose of allowing fluid to flow into said lower chamber from the exterior of said body through said inlet valve means and preventing fluid from flowing from said lower chamber to the exterior of said body through said inlet valve means;

lower fluid control means at said lower end of said fluid aperture for the purpose of allowing fluid to flow from said lower chamber of said body into said fluid aperture and preventing fluid from flowing from said fluid aperture into said lower chamber; and upper fluid control means at said upper end of said fluid aperture for the purpose of allowing fluid to flow from said fluid aperture to the exterior of said body and preventing fluid from flowing from the exterior of said body into said fluid aperture.

15. The fluid pumping apparatus of claim 14 wherein said body further includes one or more pressure equalization apertures extending through said side wall from the exterior of said body to the interior of said upper chamber of said body.

16. The fluid pumping apparatus of claim 14 wherein said body further includes tubing connection means at said upper end thereof for the purpose of connecting said body to a fluid conduit to receive fluid flowing from said fluid aperture, and wherein said plunger shaft further includes pump driver connection means for the purpose of connecting said plunger shaft to a pump driver means.

17. A method of pumping fluid from a well extending from the surface into the ground, through a string of hollow production tubing extending through the well bore, using a reciprocating pumping apparatus disposed in the well bore, connected to the production tubing and activated by a pump driver, such pumping apparatus having an elongate hollow body stationary in relation to the well bore and connected at its upper end to the lower end of the production tubing, a piston of slightly smaller cross-sectional dimension than the inner dimension of said body and having a lower face, disposed in the body in tightly fitting sliding relation and dividing the body into a lower chamber and an upper chamber, a piston shaft of substantially smaller cross-sectional dimension than the piston, connected at its lower end to the piston in coaxial relation, extending upward from the piston through the upper end of the body in fluid-tight sliding relation therewith and into the production tubing and connected at its upper end to the pump driver, a fluid conduit extending longitudinally through the piston and piston shaft, a one-directional fluid inlet valve at the lower end of the body to allow fluid to flow into the lower chamber of the body, a one-directional lower control valve at the lower end of the fluid conduit to allow fluid to flow into the conduit, and a one-directional upper control valve at the upper end of the fluid conduit to allow fluid to flow from the conduit into the production tubing, comprising the steps of lifting the piston and the piston shaft in the body of the pumping apparatus through the full upstroke of the pumping apparatus, with the lower fluid control valve and the upper fluid control valve closed and with the fluid inlet valve open, drawing fluid into the lower chamber of the body;

closing the fluid inlet valve and initiating lowering of the piston and piston shaft in the body of the pumping apparatus, opening the lower fluid control valve and the upper fluid control valve to open a fluid passageway from the lower chamber of the body through the fluid conduit and into the production tubing;

continuing lowering of the piston and piston shaft in the body of the pumping apparatus through the full downstroke of the pumping apparatus, forcing fluid from the lower chamber through the fluid conduit and into the production tubing;

closing the lower fluid control valve and the upper fluid control valve and initiating raising of the piston and piston shaft in the body of the pumping apparatus, opening the fluid inlet valve and beginning to draw fluid into the lower chamber of the body of the apparatus; and repeating the above steps to continue forcing fluid into the production tubing on each downstroke of the pumping apparatus and produce fluid from the production tubing.

18. The method of claim 17, wherein the upper chamber of the body of the pumping apparatus is penetrated by one or more vent apertures extending between the upper chamber and the exterior of the body exterior to the production tubing, and wherein the method of claim 17 comprises the additional steps of venting fluid or gas from the upper chamber of the body to the exterior of the body during lifting of said piston and piston shaft so as to prevent pressure build up in said upper chamber during upstroke of the pumping apparatus; and venting fluid or gas to the upper chamber of the body from the exterior of the body during lowering of said piston and piston shaft so as to prevent creation of a partial vaccuum in said upper chamber during downstroke of the pumping apparatus.

* * * * *